US006805557B2

(12) United States Patent
Davies et al.

(10) Patent No.: US 6,805,557 B2
(45) Date of Patent: Oct. 19, 2004

(54) BRUSH DEVICE

(75) Inventors: Richard Huw Davies, Casalpusterlengo (IT); Luca Neri, Casalpusterlengo (IT)

(73) Assignee: Unilever Home & Personal Care USA, a division of Conopco, Inc., Greenwich, CT (US)

( * ) Notice: Subject to any disclaimer, the term of this patent is extended or adjusted under 35 U.S.C. 154(b) by 0 days.

(21) Appl. No.: 10/665,230

(22) Filed: Sep. 17, 2003

(65) Prior Publication Data

US 2004/0074031 A1 Apr. 22, 2004

(30) Foreign Application Priority Data

Sep. 20, 2002 (EP) ..... 02079168

(51) Int. Cl.[7] ..... A61C 17/00; A46B 9/04

(52) U.S. Cl. ..... 433/215; 433/216; 15/167.1; 15/207.2

(58) Field of Search ..... 15/167.1, 207.2; 134/6; 433/215, 216

(56) References Cited

U.S. PATENT DOCUMENTS

| | | | | |
|---|---|---|---|---|
| 3,618,154 A | | 11/1971 | Muhler et al. | |
| 4,277,862 A | | 7/1981 | Weideman | |
| 4,373,541 A | | 2/1983 | Nishioka | |
| 4,574,788 A | * | 3/1986 | Jordan | 601/137 |
| 5,249,961 A | | 10/1993 | Hoagland | |
| 5,273,559 A | | 12/1993 | Hammar et al. | |
| 5,604,951 A | | 2/1997 | Shipp | |
| 6,199,242 B1 | | 3/2001 | Masterman et al. | |
| 6,296,934 B1 | | 10/2001 | Needham et al. | |
| 6,357,075 B1 | | 3/2002 | Kaizuka | |
| 6,432,387 B1 | * | 8/2002 | Kaizuka | 424/49 |
| 2001/0007161 A1 | | 7/2001 | Masterman et al. | |
| 2003/0084534 A1 | * | 5/2003 | Kazutoshi | 15/207.2 |

FOREIGN PATENT DOCUMENTS

| | | |
|---|---|---|
| WO | 96/20654 | 7/1996 |
| WO | 98/18364 | 5/1998 |
| WO | 98/22000 | 5/1998 |
| WO | 99/60886 | 12/1999 |
| WO | 01/21036 | 3/2001 |

OTHER PUBLICATIONS

European Search Report.

* cited by examiner

*Primary Examiner*—Randall Chin
(74) *Attorney, Agent, or Firm*—Milton L. Honig

(57) ABSTRACT

A toothbrush comprising a resilient element, said resilient element comprising an elastomer into which is incorporated an abrasive, characterized in that the abrasive is perlite.

12 Claims, 1 Drawing Sheet

BRUSH DEVICE

BACKGROUND OF THE INVENTION

1. Field of Invention

The invention provides a toothbrush comprising a resilient element into which is incorporated an abrasive.

2. The Related Art

WO 01/21036 (Unilever PLC) discloses a toothbrush with a wall-like element optionally with an abrasive.

WO 98/22000 (Asher) discloses a plaque removing member with an abrasive. This device aids in the removal of plaque during the brushing process.

U.S. Pat. No. 5,249,961 (Hoagland) discloses a portable pet teeth cleaning instrument with an abrasive pad or sponge with an abrasive composition embedded in a phenolic resin and/or embedded in or adhered to nylon fibrous strands.

WO 99/60886 (Durana) discloses a toothbrush with a polishing block made from an elastic material and which can contain an abrasive material.

U.S. Pat. No. 5,273,559 (Hammar) discloses the use of polyurea or polyurethane urea or a natural or synthetic rubber matrix with bonded abrasive particles. These articles are used in prophylactic cleaning cups for the use by high skilled dental practitioners.

U.S. Ser. No. 2001/007161 (Gillette) and U.S. Pat. No. 6,199,242 (Gillette) disclose a toothbrush with bristles containing a polishing agent to improve the cleaning of the teeth.

U.S. Pat. No. 3,618,154 (Muhler) discloses a brush with bristles moulded integrally with the brush. This brush also has abrasive incorporated into the plastic material of the brush. A disadvantage of this is that the bristles when formed in this way are difficult to mould. This is because it is hard to structure a mould that results in narrow but structurally sound bristles.

U.S. Pat. No. 4,373,541 (Nishioka) discloses the use of flexible bristles with abrasive elements such as scales, serrations, and the like formed form the bristle material in addition to abrasive particles on the side of the bristle itself.

U.S. Pat. No. 6,296,934 B1 (Needham) discloses the use of glitter containing filaments for a brush.

None of this prior art discloses perlite as an abrasive.

U.S. Pat. No. 6,357,075 (Kaizuka) discloses a hairbrush with bristles that contain an infrared material in combination with minerals, such as perlite, which radiate electromagnetic waves promoting hair growth, providing scalp care and creating shiny hair.

Hairbrush bristles have different physical properties when compared with toothbrush bristles and this represents their different function in parting hair along the bristles length during brushing. Hairbrush bristles are therefore wide enough to encompass abrasive particles such as perlite whereas toothbrush bristles, the ends of which are pointed for cleaning interstitial spaces between teeth, are very different. A disadvantage of having toothbrush bristles with abrasive particles is that as the bristles are so thin that incorporated particles weaken the structure of the bristle filament. If the bristles of a toothbrush were made thicker to accommodate an abrasive they would lose the characteristics that make then useful as toothbrushes. Hence thicker bristles in a toothbrush are disadvantageously stiff due to their extra width and they would not be able to penetrate between the teeth. Therefore, simply making a toothbrush bristle thicker to accommodate the abrasive will not aid in the process cleaning teeth.

Despite the presence in the prior art of such brushes as outlined above, there is still a need for a toothbrush which is capable of providing improved whitening or stain removal benefit while retaining the cleaning and polishing capacity of the cleaning instrument.

DEFINITION OF THE INVENTION

According to the present invention there is provided a toothbrush comprising a resilient element, said resilient element comprising an elastomer into which is incorporated an abrasive, characterized in that the abrasive is perlite.

It has been found that the addition of perlite to an elastomer aids in the removal of stains from teeth. This improves the cleaning potential of toothbrushes, which encompass this element. This improves the toothbrush's ability to remove adherent soiling matter, to free accessible plaque, to dislodge accessible debris and to remove superficial stain from the teeth which in turn leads to improved mouth feel and teeth whitening benefits. Perlite comprises flat particles which, when they are incorporated into the molten elastomer, align with the surface of the elastomer when it cools. When the resilient element is pressed against the surface of the teeth for cleaning and it elastically deforms, the perlite is maintained in a substantially parallel alignment with the surface of the elastomer. This provides the surface of the elastomer with extra rigidity hence enhancing its cleaning efficacy.

DETAILED DESCRIPTION OF THE INVENTION

The shape and alignment of the perlite particles on the surface of the elastomer means that they do not have jagged edges that protrude from the elastomer. Therefore the perlite particles in the elastomer do not damage surfaces such as teeth and soft tissue that they contact in the oral cavity. Perlite particles in the elastomer significantly enhance the cleaning potential of the resilient element so that in combination they provide for improved whitening effect without causing damage due to excessive abrasion.

The toothbrush according to the invention is for use in the oral cavity for cleaning teeth. The toothbrush according to the invention may be made from any materials commonly used in the art. Accordingly, the handle and head of the brush can be moulded from polyolefins such as polypropylenes and polyethylenes, polyamides such as nylons, and polyesters such as polyethylene terephthalate. Other suitable materials include polymethylmethacrylate, styrene acrylonitrate and cellulose esters, for example cellulose propionate.

The bristles of the brush may be made from a flexible material suitable for use in dental hygiene. Generally, materials suitable for the bristles are polyamides such as nylon or polyesters such as polybutylene terephthaiate.

The brush according to the invention may be a manual toothbrush or an electrically driven toothbrush.

The resilient element may take the form of a pick, a finger, a prong, or a fork structure. According to a preferred embodiment the resilient element is wall-like. A wall-like structure allows for whitening or polishing benefit, as the wall-like structure can be elastically deformed thereby exerting pressure on the teeth for cleaning benefit while not exerting such a force as to damage the teeth. Similarly it can not just be moved to one side, as may be the case with a pick. In addition to this the wall-like structure may be designed to be of such a width that it effectively comprises perlite without compromising the stability and structure of the elastomer which makes up the wall-like element.

It is envisaged that the resilient element can be made by any conventional method, i.e. die-cut or moulded. However, a preferred method of making such a structure would be by injection moulding. The material of the resilient element may be linked to the head of the toothbrush in any way whether it is by chemical means, mechanical means or both.

Preferably the resilient element material is chemically compatible with the material of the head and they may he joined by application of heat, e.g. during injection moulding of one or the other.

Alternatively the materials may be chemically incompatible, e.g. the resilient element comprising a thermoplastic elastomer and the brush head comprising polypropylene. It may, therefore, be more suitable to use an adhesive or to mechanically attach the two parts to one another. An alternative method of attaching the resilient element comprising a thermoplastic elastomer to a head comprising polypropylene would be to increase the surface area of the area of attachment, e.g. by corrugating one or both, and then fixing the two together by welding or otherwise.

It may also be that the resilient element is contiguous with another portion of the brush comprising the same material and that both are filled through one or more injection points. For example, the resilient element and a grip region on the handle are contiguous through a channel running along the head to the handle.

It may also be that the resilient element and the grip region on the handle have separate injection points so that the resilient element encompassing the perlite can be injected into the head region of the toothbrush while the grip region of the handle may not contain any perlite.

The resilient element may be flanked by bristles. Such flanking may be a mere scattering of bristles but it is preferred that the bristles are located outermost on the brush head and the resilient element is located more centrally. This is a particularly beneficial design as it allows the teeth to be cleaned while also allowing the teeth to be polished. The bristles are flexed outwardly to allow the resilient element to contact the teeth and this further improves the cleaning efficacy of the brush. Should the resilient element be located at the outer edges of the brush head the flexing of the bristles would compromise the polishing and whitening capability of the brush.

To further enhance the benefit described above it is preferred that the bristles are longer than the resilient element. This ensures that the bristles extend further from the head than does the resilient element. This creates a recess in the center of the brush head which further allows the flexing of the bristles to effect good cleaning while allowing the resilient element to whiten the teeth.

The perlite in the resilient element according to the invention may be any perlite or mixtures of perlite commonly known in the art. It can be crude or non-expanded perlite. Preferably it is expanded perlite which has been quickly heated to above 871° C. in order to allow for expansion and then subsequently cooled.

The perlite preferably has an abrasion value of 125 to 150 using RDA, (J Dent Res 37: 1060–1068, 1958 or J Dent Res 55:563 to 573, 1976.). Preferably the perlite is E 50 perlite available from Worldminerals Italia srl., Alzaia Trento 6, 20094 Corsico, Milano, Italy.

The perlite composition preferably contains $SiO_2$ 70–75% w/w, $Al_2O_3$ 10–15% w/w, $Fe_2O_3$ 0.5–1% w/w, $Na_2O$ 4–5% w/w, $K_2O$ 7–9% w/w, CaO 0.2–0.4% w/w, MgO 0.05–1.5% w/w, $TiO_2$ 0.05–1.5% w/w.

The perlite is added to the elastomer during its processing, preferably the perlite is added to the resilient element while the elastomer is being readied in the master batch prior to injection moulding. Most preferably the perlite is added to the compounder at the same time as any colourants.

According to another embodiment of the present invention the perlite is present from 0.01% to 50% v/v of the elastomer. Preferably the perlite is present from 10% to 30% v/v of the elastomer. Most preferably the perlite is present from 15% to 25% v/v of the elastomer.

In its expanded form the perlite has a high porosity with a large available surface area thereby increasing the surface area to volume ratio. These properties mean that a relatively small weight percent of perlite has such a large surface area that it gives effective whitening and other tooth polishing benefits at low weight levels.

According to another embodiment of the invention the perlite is present from 0.01% to 10% w/w of the elastomer. Preferably the perlite is present from 1% to 8% w/w of the elastomer. Most preferably the perlite is present from 2% to 4% w/w of the elastomer.

The porosity of the perlite means that it is a relatively lightweight particle.

Therefore it is less likely to deform the resilient element during production or use of this element. As a result of this there is less chance of flex fatigue occurring in the resilient element because the stacks of perlite do not interfere with its resilient properties.

According to another preferred embodiment the weight median particle diameter of the perlite is from 10 $\mu$m to 50 $\mu$m. Preferably the weight median particle diameter is from 20 $\mu$m to 45 $\mu$m. Most preferably the weight median particle diameter of the perlite is from 30 $\mu$m to 40 $\mu$m.

Preferably 90% by weight of the perlite has a particle diameter less than 70 $\mu$m to 110 $\mu$m. Preferably 10% by weight of the perlite has a particle diameter less than 7 $\mu$m to 10 $\mu$m. The particle size distribution of the perlite is determined using laser light scattering (Malvern 3600E, 300 mm Lens).

According to another preferred embodiment the perlite has a bulk density of 100 to 180 g/l.

The bulk density of the perlite can be 50 to 350 g/l. Preferably the perlite has a bulk density of 70 to 200 g/l. Most preferably the bulk density of the perlite is 80 to 110 g/l. The bulk density of the perlite is measured by starting with homogeneous perlite particles, a set amount is then weighed and then it is shaken to pack it down. The volume that it occupies is measured and this is then divided by the weight.

The particles of perlite according to the present invention disperse effectively into the elastomer when the perlite is added to the elastomer. This dispersion of the perlite in the elastomer means that their cleaning benefit is consistent or the teeth that they contact. This property of the perlite also means that the interference that the perlite has with the binding of the elastomer to the handle and or head of the polypropylene toothbrush skeleton is minimised as there will not be pockets of perlite that can disadvantageously interfere with this interaction. The binding of the elastomer to the handle or head of the toothbrush is also aided by the alignment and shape of the perlite particles.

Preferred resilient element materials are thermoplastic elastomers for ease of injection moulding. The elastomer is made of a polymer material, such as a block co-polymer, preferred block co-polymers include polyolefins (for example polypropylene/ethylene propylene diamine modified systems (i.e. synthetic rubber)), polyamides (for example polyamide (2 or polyamide 6), polyesters (for example polyester ester or polyether ester), polyurethanes (for example polyesterurethane, polyetherurethane or polyesteretherurethane). According to another preferred embodiment the elastomer comprises a styrene block copolymer. Preferred styrene block copolymers include for example styrene ethylene butadiene styrene, or styrene butadiene styrene.

Elastomer materials can be two phase systems, which contain an internal phase material in a continuous phase of another material. A particularly preferred example of this is the polypropylene/ethylene propylene diamine modified material described above, which is commercially available as Santroprene PPA (ex Advanced Elastomer Systems). Such two phase materials may conveniently have a continuous external thermoplastic phase, with the internal phase typically containing particles which may be in the order of 0.5 $\mu$m to 5 $\mu$m across.

To facilitate and simplify bonding of the resilient element to the head, the head may be made of materials which are of similar or even the same character, so that they for example have similar functional groups, similar levels of functionality, similar surface energies, and so on. Such similarity may facilitate adhesion of the respective components.

Alternatively, one or more components can be chemically modified by a chemical surface treatment to facilitate its adhesion to an adjacent component such as surface oxidation (e.g. by flaming, or by electrical discharge).

According to another preferred embodiment the elastomer has a Shore A hardness of 5 to 80. Preferably the elastomer has a Shore A hardness of 20 to 50. Most preferably the elastomer has a Shore A hardness of 25 to 35

The resilient material needs to be a material soft enough to provide whitening and polishing benefit to the teeth and to increase the efficacy of the toothbrush without having a negative impact on the gums and enamel.

According to another aspect of the present invention there is provided the use of a toothbrush according to any preceding claim for whitening teeth.

Embodiments of particular toothbrushes according to the invention will now be described in more detail with reference to the following figures.

DRAWING DESCRIPTION

BRIEF DESCRIPTION OF THE DRAWINGS

FIG. 1*a* is an elevational view of the head and part of the handle of a toothbrush according to the invention. FIG. 1*b* is a plan view of the toothbrush according to the invention as shown in FIG. 1*a*.

DETAILED DESCRIPTION OF THE DRAWINGS

Figure 1A:
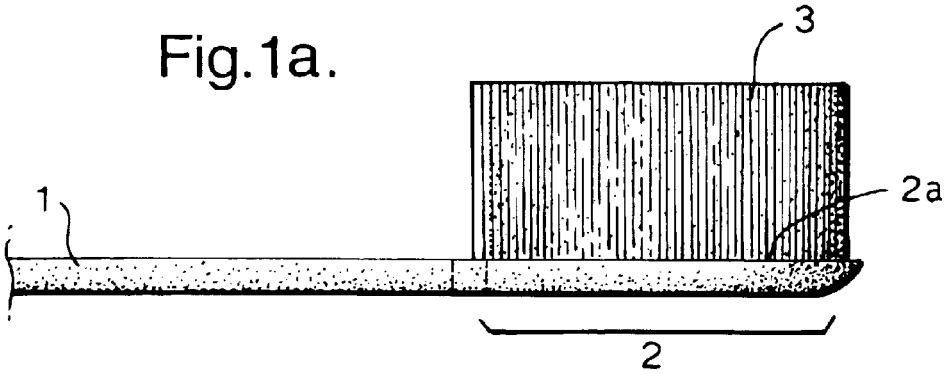
FIGS. 1*a* and 1*b* show a single toothbrush in various views.

FIG. 1*a* shows a toothbrush comprising a handle (1) and a head (2). The head has a bristle bearing surface (2*a*) from which extend bristles (3).

Figure 1B:
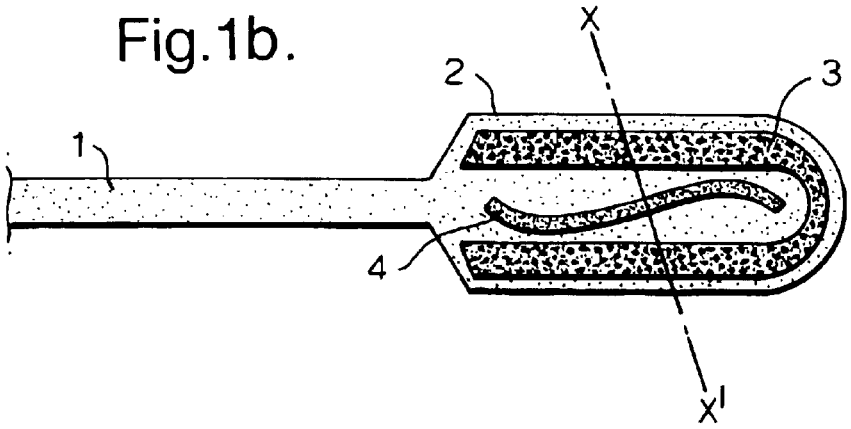

FIG. 1*b* shows a toothbrush according to FIG. 1*a* additionally showing an upstanding resilient element in the form of a wall-like structure (4). The wall-like structure (4) is shown in plan view but it clearly runs along a significant length of the head (2) and, in plan view, appears longer than the length of the head. The bristles (3) extend further from the head (2) than the wall-like structure (4).

Figure 2:
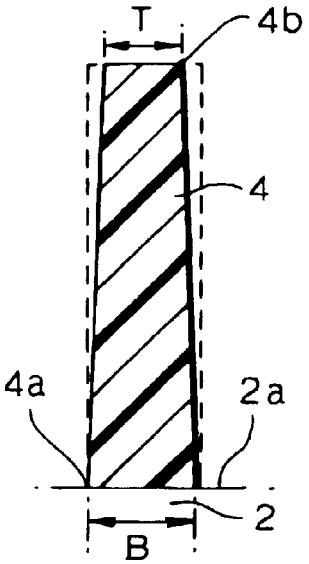
FIG. 2, FIG. 3 and FIG. 4 are cross-sections along the line X to X' in FIG. 1*b* of the resilient member according to the invention.

FIG. 2 shows a cross-sectional view of a wall-like structure (4) which tapers away from the bristle bearing surface (2*a*) of the brush head (2). By tapered away from the brush head is meant that the wall-like structure has a base (4*a*) and a tip (4*b*) and the distance across the base (B) is greater than the distance across the tip (T).

Figure 3:
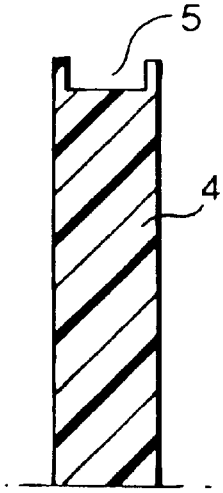

FIG. 3 shows a wall-like structure (4) with a ridge (5) running along the tip. It may or may not be that the ridge runs along the entire length of the member.

Figure 4:
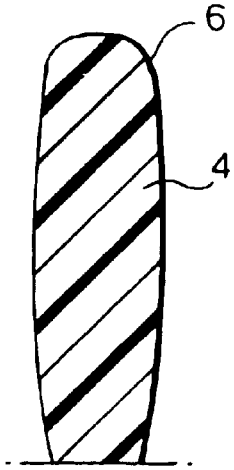

FIG. 4 shows a wall-like structure (4) which has a rounded surface (6). By rounded it is meant that there are no square edges on the structure.

We claim:

1. A toothbrush comprising:

(i) a brush head comprising a bristle bearing surface from which extend bristles and a resilient element extending upstanding from the bristle bearing surface, said resilient element comprising an elastomer into which is incorporated an abrasive which is perlite; and (ii) a handle attached at one end thereof to the brush head.

2. A toothbrush as claimed in claim 1, in which the perlite is present from 0.01% to 50% v/v of the elastomer.

3. A toothbrush as claimed in claim 1, in which the perlite is present from 0.01% to 10% w/w of the elastomer.

4. A toothbrush as claimed in claim 1, in which the median particle diameter of the perlite is from 10 to 50 $\mu$m.

5. A toothbrush as claimed in claim 1, in which the resilient element is wall-like.

6. A toothbrush as claimed in claim 1, in which the elastomer comprises a styrene block copolymer.

7. A toothbrush as claimed in claim 1, in which the elastomer has a Shore A hardness from 5 to 80.

8. A toothbrush as claimed in claim 1 in which the perlite has a bulk density of 100 to 180 g/l.

9. A toothbrush as claimed in claim 1, in which the resilient element has a left and right surface juxtaposed to one another with a set of bristles flanking the left side and another set of bristles flanking the right side of the resilient element.

10. A toothbrush as claimed in claim 1, in which the bristles are located outermost on the brush head and the resilient element is located more centrally.

11. A toothbrush as claimed in claim 1, in which bristles are longer than the resilient element thereby creating a recess in a center of the brush head.

12. A method of whitening the teeth by brushing with a toothbrush comprising a resilient element, said resilient element comprising an elastomer into which is incorporated an abrasive, characterized in that the abrasive is perlite.

* * * * *